United States Patent [19]

Summers

[11] 4,413,743

[45] Nov. 8, 1983

[54] CHILD-RESISTANT SAFETY CLOSURE

[75] Inventor: Kenneth L. Summers, Angola, Ind.

[73] Assignee: Rieke Corporation, Auburn, Ind.

[21] Appl. No.: 440,516

[22] Filed: Nov. 10, 1982

Related U.S. Application Data

[63] Continuation of Ser. No. 314,652, Oct. 26, 1981, abandoned, which is a continuation-in-part of Ser. No. 217,409, Dec. 17, 1980, Pat. No. 4,351,442.

[51] Int. Cl.[3] ..... B65D 55/02

[52] U.S. Cl. ..... 215/216

[58] Field of Search ..... 215/216, 218, 221, 330; 222/153

[56] References Cited

U.S. PATENT DOCUMENTS

| | | | |
|---|---|---|---|
| 3,360,147 | 12/1967 | Schaefer | 215/216 |
| 3,831,797 | 8/1974 | Stevens, Jr. | 215/216 |
| 3,857,508 | 12/1974 | LaBarge et al. | 215/221 |
| 3,941,268 | 3/1976 | Owens et al. | 215/216 |
| 3,944,101 | 3/1976 | Landen et al. | 215/216 |
| 4,116,351 | 9/1978 | Uhlig | 215/216 |
| 4,117,945 | 10/1978 | Mumford | 215/216 |

FOREIGN PATENT DOCUMENTS

| | | |
|---|---|---|
| 943494 | 3/1974 | Canada . |
| 966433 | 4/1975 | Canada . |
| 1023299 | 12/1977 | Canada . |

*Primary Examiner*—George T. Hall

*Attorney, Agent, or Firm*—Woodard, Weikart, Emhardt & Naughton

[57] ABSTRACT

A child-resistant safety container for preventing access to the contents by small children and infants includes a positive-on closure concept and necessitates a two-step release procedure in order to remove the cap from the container spout. The closure cap includes an internally threaded side wall with a pair of inwardly protruding lug means. The internally threaded cap is suitably adapted for receipt by an externally threaded container spout. Disposed in combination with the container spout are sawtooth detent means including two series of ratchet teeth which are spaced approximately 180 degrees apart. These ratchet teeth are suitably sized and arranged for interlocking engagement with the inwardly protruding lug means. However, one series of ratchet teeth are offset from the other series by a half ratchet tooth spacing so that the engagement of the locking lugs with the ratchet teeth alternates from one locking lug to the other with each angular turn equal to a half ratchet tooth. The ratchet teeth have an axial height which is sufficient to prevent removal of the cap with one 180-degree turn. In order to remove the cap from the container spout, it is required that the closure cap be distorted into an elliptical shape and two turns of approximately 180 degrees each be performed.

5 Claims, 10 Drawing Figures

CHILD-RESISTANT SAFETY CLOSURE

REFERENCE TO RELATED APPLICATIONS

This application is a continuation of application Ser. No. 314,652, filed Oct. 26, 1981 now abandoned which is a continuation-in-part patent application of co-pending patent application U.S. Ser. No. 217,409 filed Dec. 17, 1980 now U.S. Pat. No. 4,351,442.

BACKGROUND OF THE INVENTION

This invention relates generally to closure caps for bottles and containers and in particular to closure concepts referred to as positive-on closures which are child-resistant by their arrangement and their nature of engagement with the container spout. Bottles and containers which contain dangerous or harmful materials represent a serious risk to small children and infants. These materials may include such items as cleaning solutions, medicines, caustic chemicals and poisons such as herbicides and insecticides. These types of material are frequently found in the home, in such places as basements, cupboards, cabinets and unfortunately, simply sitting out on floors and counters. Even with one child, it is very difficult to control that child's activities every minute of every day, and the searching, inquisitive nature of children all too frequently brings the child into contact with these types of material containers. Consequently, there is a critical need to adapt such containers with closures which cannot be defeated by small children and infants.

A wide variety of child-resistant safety closures are known to exist, and although each may afford certain improvements, none are believed to anticipate the present invention. Many closures include a type of cap-to-spout interlock which requires some type of deformation of the cap while unscrewing the cap from the spout in order to defeat the interlocking engagement. However, the specific details and characteristics of these types of closures are critical, and it is not believed that the optimal combination of features has yet been provided.

Prior closure concepts which may be relevant to the present invention are disclosed in the following listed patents.

| Patent No. | Patentee | Issue Date |
|---|---|---|
| 3,941,268 | Owens et al. | 3/02/76 |
| 4,117,945 | Mumford | 10/03/78 |
| 3,944,101 | Landen et al. | 3/16/76 |

Owens et al. discloses a safety closure and container wherein a single walled cap provided with both internal threads and a pair of internal locking lugs is arranged to threadedly fit over a container spout. Associated with the spout are two camming projections, 180° apart. The locking lugs have a sufficient axial height so that when the cap is fully tightened onto the spout, two separate squeezing actions are required in order to disengage the lugs from the projections so that the cap may be removed from the spout.

Mumford discloses a double side wall child-resistant safety closure wherein the inner side wall is internally threaded and the outer side wall includes two locking ribs. These ribs are arranged to interlock with shoulder segments disposed at the base of the spout of the corresponding container. This patent specifically refers to and discusses the foregoing Owens et al. patent and focuses on the benefits to be afforded by the double side wall construction. In virtually all other respects, these two patent disclosures are quite similar.

Landen et al. discloses a safety closure which includes upraised sawteeth around the base of the container spout and a continuous inner circumference of matching sawteeth on the lower interior edge of the corresponding cap. The surrounding body of the cap is configured for deformation as the cap is threaded onto the spout. These two sets or series of sawteeth have a ratchet-like design and are able to engage one another almost immediately upon receipt by the spout of that first thread of the cap. As the threaded advancement of the cap onto the spout continues, downward axial pressure is applied on the engaged series of sawteeth and this pressure increases until it reaches a relatively high force level. Removal of the cap is then effected by applying an uplifting force on the cap which is sufficient to overcome the downward axial pressure. This uplifting force draws the sawteeth out of engagement and while out of engagement, the cap is unscrewed from the spout. In one arrangement, the upraised sawteeth disposed around the spout are arranged into two series which are approximately 180° apart but offset by the space of one half tooth so that engagement occurs in an alternating manner, every one half tooth of turning.

What is not provided by these patent disclosures is a combination of those benefits provided by the double side wall design and the half tooth offset ratchet design while still incorporating the convenience for adults of being able to easily remove the closure cap from the spout. In the disclosed arrangements of Owens et al. and Mumford, there is very little, if any, control of the engagement of the ribs and shoulder segments relative to the threaded receipt of the cap by the spout. In this regard, there is no interlocking engagement until the cap is almost fully threaded onto the spout. Thus, there is not afforded by these designs a positive-on arrangement wherein the closure is locked into position on the spout even when applied with insufficient torque to fully tighten the cap onto the spout.

Landen et al. attempts to overcome the foregoing shortcomings by its convoluted cap design wherein ratchet tooth engagement occurs almost at once and is maintained with the engagement of the first thread of the cap by the spout. Thereafter, as the cap advances onto the spout, the downward axial force pressing the two sets of ratchet teeth together increases until full threaded engagement is achieved. The result is a very tight and forceful safety closure fit. While this particular arrangement may achieve its one objective of being "child-resistant," its design introduces another problem. This other problem is that the removal of the cap becomes quite difficult for certain elderly persons and others who may suffer from an arthritic condition. These types of persons do not have the manual dexterity required to deal with this type of safety closure. This particular design concept relies primarily on strength in order to make it child-resistant in that an excessive amount of force is necessitated in order to remove the cap. However, it is also known that safety closures may be made child-resistant by necessitating an intricate sequence of removal steps so that mental capacity is the determinant and not physical strength.

With closure concepts of the type wherein the cap must be distorted, such as making it elliptical, in order to disengage the locking ribs from the shoulder or to disengage one set of ratchet teeth from a mating set, there is a need to know where to grasp or compress the cap so that the distortion is effective. However, certain disclosures such as that of the Mumford patent refer to the benefits of having the interlocking members "inaccessible and unobservably secluded within the interior confines of the closure." Consequently, there is no exterior indication of where to compress the outer wall and it is believed to be an improvement to provide some means of identification of these compression points. Although it might be argued that exterior identification aids the child, it must be noted that the children are small and not likely to be able to ascertain for what the identification is intended, especially if surface texturing or raised portions are used instead of descriptive words.

The present invention provides a variety of advantages over prior art devices while at the same time incorporating in a novel manner certain beneficial aspects of these prior devices. The resultant combination is a safety closure which serves the ends of adult users, including those with ailments or minor disabilities such as arthritic conditions, while maintaining the closure as "child-resistant" as will be understood by the following descriptions.

SUMMARY OF THE INVENTION

A child-resistant safety closure adapted for threaded receipt by an externally threaded container spout and arranged into a positive-on style which necessitates a two-step release procedure according to one embodiment of the present invention comprises detent means disposed about the externally threaded container spout and having two series of outwardly radiating ratchet teeth wherein the leading edge of one series of ratchet teeth is spaced from the leading edge of the other series of ratchet teeth by approximately 180 degrees less the angular extent of one-half of a ratchet tooth and further comprising a closure cap having a side wall which is internally threaded for receipt by the container spout, the side wall includes two inwardly directed lug means which are spaced approximately 180 degrees apart and are suitably arranged to provide a positive-on lock with the two series of ratchet teeth so that the ratchet tooth engagement with the protruding lugs alternates back and forth, the lug means are arranged with a sufficient axial height so as to necessitate two turns of approximately 180 degrees each in order to raise the lug means above the series of ratchet teeth in order to defeat the positive-on lock.

One object of the present invention is to provide an improved child-resistant safety closure.

Related objects and advantages of the present invention will be apparent from the following description.

DESCRIPTION OF THE PREFERRED EMBODIMENT

Figure 1:
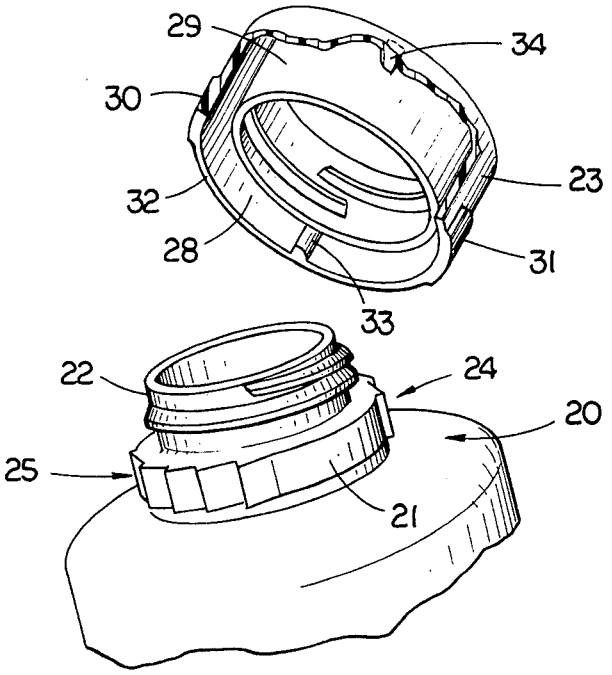
FIG. 1 is an exploded, fragmentary, perspective view of a child-resistant safety closure according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a child-resistant safety closure 20 arranged with detent means 21 disposed about container spout 22 and a closure cap 23.

Detent means 21 includes two series 24 and 25 of ratchet teeth having a generally sawtooth configuration. These sawteeth extend outwardly in a radiating pattern and are spaced apart such that the leading edge of one series is approximately 180 degrees from the leading edge of the other series. The specific shape and angular position of the sawteeth are detailed in FIG. 4 and will be discussed additionally hereinafter.

Closure cap 23 is configured into a double wall construction including outer wall 28 and inner wall 29. The exterior surface of outer wall 28 is generally cylindrical but does include two oppositely disposed thicker portions 30 and 31 which serve as compression tabs and as an identification of the location where closure cap 23 needs to be compressed in order to elliptically deform the cap so that the closure cap can be disengaged from the two series of ratchet teeth. These two thicker portions extend from bottom edge 32 upwardly approximately one-third of the total height of closure cap 23. The inner surface of outer wall 28 includes two inwardly protruding lugs 33 and 34 which extend for substantially the entire height of the closure cap. These two protruding lugs have a generally quadrant cross-sectional shape (see FIG. 3) and are sized and arranged to engage the two series of ratchet teeth in a secure, interlocking fashion. These two protruding lugs are approximately 180 degrees part and their curved sides ride over the ratchet teeth as the cap is screwed onto container spout 22. Similarly, the straight or flat side or surface of these protruding lugs abuts against the shoulder portion of the ratchet teeth in the event the cap is attempted to be unscrewed from the container spout. Portions 30 and 31 are equally spaced between lugs 33 and 34.

Inner wall 29 is internally threaded and the size and pitch of these threads matches the size and pitch of the external threads disposed about container spout 22. Due to the full height, of the protruding lugs and the increased height in the axial direction, of the two series of ratchet teeth, it is to be understood that the protruding lugs are placed in interlocking engagement with the two series of ratchet teeth almost immediately when the closure cap is placed over the container spout. This is true even though threaded engagement between the internal threads of inner wall 29 and the external threads of spout 22 has not yet begun. As closure cap 23 is threadedly advanced onto container spout 22, the protruding lugs 33 and 34 are rotated across the two series of ratchet teeth. As this rotation occurs, the protruding lugs ride up and over the ramp portion of each sawtooth and then drop down into a detent fashion at the end of each sawtooth. In order to achieve this ratchet engagement, it is required that outer wall 28 yield or flex in order to enable the protruding lugs to move across the ratchet teeth. However, it is important to note that this type of closure is considered to be a "positive-on" in that ratchet tooth engagement occurs and prevents removal of the closure cap even if full threaded engagement between the cap and spout is not achieved. Thus, as soon as there is that first partial engagement of a single thread, the cap becomes locked onto the spout and can only be removed by properly compressing the thicker portions 30 and 31 of the outer wall in order to cause an elliptical deformation in the cap which expands the protruding lugs outwardly and removes them from engagement from the two series of ratchet teeth.

Figure 2:
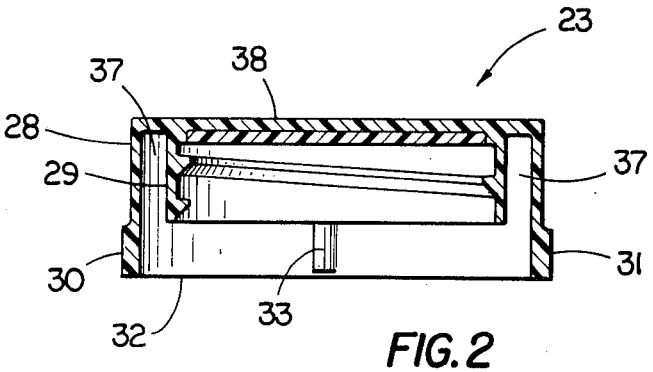
FIG. 2 is a side elevation view in full section of the closure cap portion of the FIG. 1 safety closure.
Figure 3:
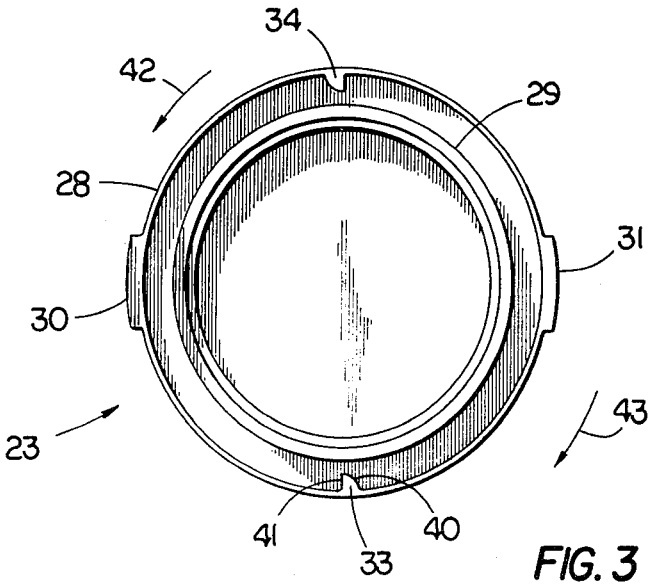
FIG. 3 is a bottom plan view of the FIG. 2 closure cap portion.

Referring to FIGS. 2 and 3, closure cap 23 is illustrated in greater detail. Disposed between inner wall 29 and outer wall 28 is a generally cylindrical clearance region 37 which provides space for deformation of the outer wall of the cap. The general thickness and height of thicker portions 30 and 31 is also clearly illustrated by the FIG. 2 section view and these portions are additionally detailed in FIG. 3. Although the general size and geometry of thicker portions 30 and 31 is believed to be aesthetically pleasing and functionally suitable, there are particular benefits provided by the specifics of this construction. By having these thicker portions raised beyond the outer surface of outer wall 28, these thicker portions can be identified and located by touch alone. This is a benefit to visually impaired persons who might have difficulty in trying to read a marking in order to determine at what location this outer wall should be compressed in order to disengage the protruding lugs from the ratchet teeth. It is also beneficial to assure that compression or squeezing together of these two thicker portions provides sufficient deformation for the disengagement of the protruding lugs and the ratchet teeth.

If the compression points on the outer wall were very thin and flexible, as opposed to being thicker as illustrated, then there would be a certain degree of yielding at the point of compression and a significant amount of the compressing force could be absorbed by this localized deformation. Therefore, there would not be sufficient force transmitted to the entire closure cap perimeter in order to deform the cap to a sufficient elliptical shape so as to provide the necessary movement outwardly of the protruding lugs. Although this type of inadequacy could be resolved by simply compressing the two tab portions or compression points farther inwardly, there is only a limited amount of travel permitted before this outer wall interferes with the inner wall or spout. By providing compression tabs in the style of thicker portions 30 and 31, any localized yielding or deformation at the points of compression is minimized and the particular design assures that a maximum portion of the compression force is transferred into elliptical deformation of the closure cap.

Inner wall 29 extends downwardly from top surface 38 and terminates at bottom edge 39. It is to be noted that bottom edge 39 is approximately coincident with the uppermost edge of thicker portions 30 and 31. This positional and size relationship is important in view of the particular configuration of the container spout and the location of detent means 21.

The quadrant shape of protruding lugs 33 and 34 is best illustrated in FIG. 3. Each of these lugs includes a curved surface 40 and a flat opposite shoulder surface 41. Arrow 42 indicates the direction of advancement of the cap onto the spout in order to tighten the cap onto the spout. Alternatively, arrow 43 represents the direction of turning of the cap in order to unscrew it from the container spout. As should be appreciated, in the advancing procedure of the cap onto the spout curved surface 40 rides across the various ratchet sawteeth. Thereafter, when the cap is attempted to be removed, flat shoulder 41 abuts against the shoulder portion of its corresponding and engaged ratchet tooth. Therefore, these protruding lugs must be moved apart from the ratchet teeth or in some manner defeated in order to be able to unscrew the cap.

Figure 4:
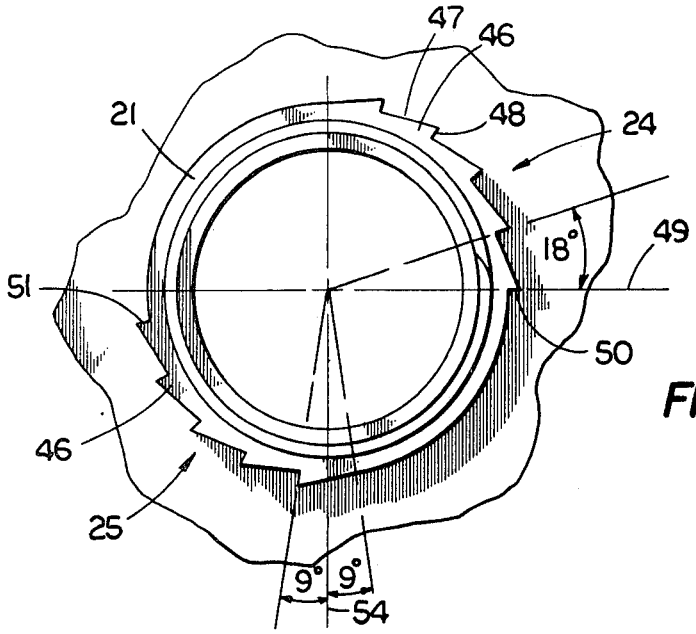
FIG. 4 is a top plan view of the detent means portion of the FIG. 1 safety closure as arranged about the spout of a corresponding container.
Figure 5:
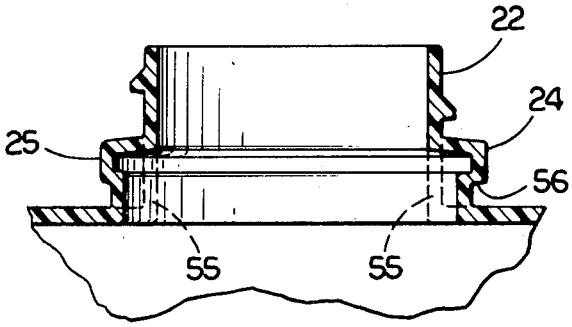
FIG. 5 is a side elevation view in full section of the FIG. 4 spout and detent member portion.

Referring to FIGS. 4 and 5, the details of detent means 21 and its relationship to container spout 22 are illustrated in greater detail. Detent means 21 can be considered as a generally cylindrical ring portion integral with the spout which includes radiating outwardly therefrom two series of ratchet teeth, the teeth having a sawtooth profile. Each ratchet tooth 46 of each series 24 and 25 has a ramp portion 47 and a shoulder portion 48. For the purposes of discussing the angular relationship between first series 24 and second series 25, the first series has been oriented such that shoulder portion 48 of the first ratchet tooth coincides with horizontal line 49 and constitutes the leading edge 50 of first series 24. Similarly, the shoulder portion of the first ratchet in the second series has a leading edge 51 which is approximately 180 degrees from leading edge 50. Although leading edge 50 is approximately 180 degrees from leading edge 51, there is a specific and important relationship between these two series of ratchet teeth. As is noted, each ratchet tooth has an angular extent of approximately 18 degrees and therefore five ratchet teeth comprise a full 90 degrees quadrant of the cylindrical detent member. While leading edge 50 is coincident with horizontal line 49, leading edge 51 is slightly below that horizontal line. This fact is accounted for by the half ratchet tooth offset of 9 degrees wherein the last ratchet of series 25 is disposed equally on each side of vertical line 54. Thus, while each series 24 and 25 of ratchet teeth 46 are identical, they are offset by a half ratchet tooth spacing such that one leading edge is spaced from the opposite leading edge a distance equal to 180 degrees minus the angular span corresponding to a half ratchet tooth offset.

Since the two protruding lugs are 180 degrees apart, it is to be understood that when one protruding lug is fully engaged with a corresponding ratchet tooth, the opposite protruding lug is only half engaged. The concept of half engagement basically means that the lug is disposed midway across ramp portion 47 of the corresponding ratchet tooth. As cap 23 is threaded onto the container spout, the two protruding lugs alternately achieve full engagement with each corresponding ratchet tooth in an alternating and sequential manner.

First, one protruding lug achieves full engagement with a first ratchet tooth and then a half ratchet tooth turn later (in this case 9 degrees) the opposite protruding lug achieves full engagement with its corresponding ratchet tooth. When this occurs, the first protruding lug has begun to ride up and across the ramp portion 47 of the next ratchet tooth of its corresponding series. This half ratchet tooth offset assures a very tight and snug ratchet tooth engagement and enables full engagement to be achieved with a smaller degree of angular turn than would otherwise be possible if the two series of ratchet teeth were truly 180 degrees apart and otherwise identical.

Referring to FIG. 5, the axial height of the two series of ratchet teeth is illustrated. Although in the preferred embodiment it is likely that the detent means 21 will be integrally formed as part of the container spout 22, it should be understood that this is not particularly a requirement. Broken lines 55 have been added to illustrate the possible original size and shape for the container spout if detent means 21 is provided as an add-on component after the spout is formed or if provided as a retrofit to existing spouts. If the particular container merely has a straight cylindrical externally threaded spout, and detent means is not provided, then it is envisioned that detent means of an annular ring design will be provided as a separate member. In order to then create the general appearance illustrated in FIG. 5, this annular ring detent means must be placed around the base of the spout. This may be done by a variety of attachment means and concepts and whether threaded or slid over the spout, once the detent means is in position, it is rigidly secured such as by cementing in place or heat welding. Since containers and caps are frequently fabricated as a single unit, it is envisioned that in most instances, the cap style disclosed herein will be provided as part of a specially designed container. In this regard, it is believed that the most efficient fabrication means is to mold the detent member as an integral part of the container and the container spout as is illustrated by the solid lines of FIG. 5. It is only important to note that this particular design arrangement is not intended to be restrictive nor otherwise limiting and the foregoing discussion regarding the detent member as a separate component does have certain applicability in certain circumstances.

Figure 6:
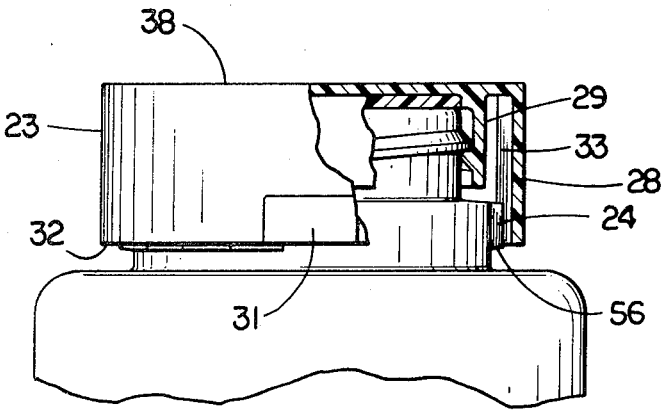
FIG. 6 is a fragmentary side elevation view of the FIG. 1 safety closure as installed on a container spout.

Referring to FIG. 6, the axial relationship between cap 23 and spout 22 is illustrated. It is to be noted that the protruding lugs do extend the full height of cap 23 and with the cap fully threaded onto the spout, these protruding lugs extend close to the lower or bottom edge 56 of each series of ratchet teeth. With an internal and external thread pitch of approximately 5 threads per inch, one 360-degree turn of closure cap 23 will advance or retract that cap an axial distance of approximately 0.2 inches (5.08 mm). Correspondingly, by configuring the two series of ratchet teeth with an axial height of approximately 0.18 inches (4.57 mm), it will necessitate between 80 and 90% of a full revolution in order to raise the bottom edge of the two protruding lugs above the top surface of the series of ratchet teeth. When manually unscrewing a cap from a container spout, any single manual turn of the cap is generally limited to 180 degrees. Consequently, when thicker portions 30 and 31 are compressed so as to outwardly expand the protruding lugs to a state of disengagement from the ratchet teeth, the closure cap may be turned. However, this first turn is limited to 180 degrees and therefore, is not sufficient to remove the protruding lugs from continued engagement with the ratchet teeth when the pressure on thicker portions 30 and 31 is relieved and the cap returns to its normal, generally cylindrical shape. Therefore, a second compression step is required in order to disengage the cap from the container spout.

Figure 7:
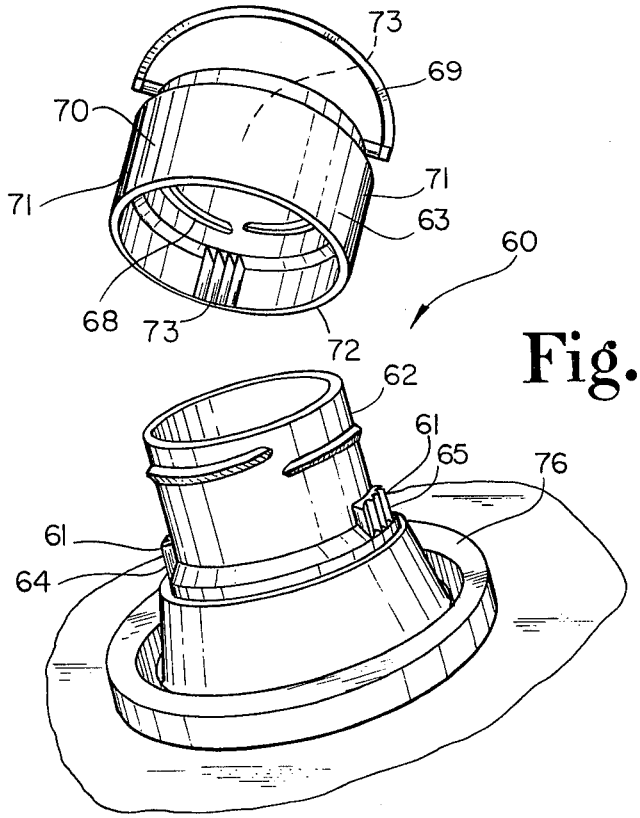
FIG. 7 is an exploded, fragmentary, perspective view of a child-resistant safety container according to a typical embodiment of the present invention.

Referring to FIG. 7, an alternate typical embodiment of the present invention is illustrated. Child-resistant safety closure 60 includes detent means 61 disposed about container spout 62 and a closure cap 63. Detent means 61 includes two series 64 and 65 of ratchet teeth having a generally sawtooth configuration. These sawteeth extend outwardly in a radiating pattern and are spaced apart such that the leading edge of one series is approximately 180 degrees from the leading edge of the other series (less one-half tooth). The specific shape and angular position of the sawteeth are detailed in FIG. 10 and will be discussed additionally hereinafter.

Closure cap 63 is configured into a single-wall construction including internal threads 68 and bail handle 69. The outer surface of wall 70 includes two ribbed areas 71 whose maximum thickness is just slightly greater than that of wall 70 so as to give these two ribbed areas a raised and textured feel. These two areas serve as compression tab locations or squeezing ribs so that the normal cylindrical shape of cap 63 which is molded of a flexible plastic, may be distorted to an elliptical shape by applying a compression force in order to draw the two areas toward one another. Once flexible cap 63 is so deformed, it may be disengaged from the two series 64 and 65 of ratchet teeth as explained hereinafter. It is important to note that for such disengagements, more than one turn of 180 degrees of the cap relative to the spout, is required. The two ribbed areas extend from bottom edge 72 upwardly for virtually the entire height of wall 70.

The inner surface of wall 70 includes two inwardly directed lug means 73 which extend from bottom edge 72 upwardly into the closure cap 63 to a point adjacent to where internal threads 68 begin. Each of the lug means are arranged in a sawtooth configuration and each lug means has a series of lug teeth. These two series each include a plurality of lug teeth and the series are spaced approximately 180 degrees apart. The two series of lug teeth each have an axial height (the axial direction being substantially parallel to the axis of rotation of the cap) which is of sufficient magnitude so as to necessitate more than one turn of 180 degrees to disengage the cap from the spout as previously disclosed. While it would be sufficient to have relatively short lug teeth in order to adequately engage the two series of ratchet teeth for providing a positive-on locking feature, this locking engagement could be easily defeated and the cap disengaged from the spout with one turn of approximately 180 degrees of the cap relative to the spout. This conclusion that one turn would be sufficient with short lug teeth is based upon the pitch of the threads on the spout and in the cap. Clearly, the axial height of the lug teeth must be sized in accordance with the thread pitch, and in accordance with the teachings of this invention, the lug teeth have an axial height of sufficient magnitude to practice the claimed invention. As an example, if the thread pitch is four threads per inch, then a sufficient axial height will be something over $\frac{1}{8}$ inch.

In the exemplary embodiment there are four individual lug teeth in each of the two series. Each of these lug teeth are cooperatively arrange to abut against and engage the individual ratchet teeth of series 64 and 65. The individual lug teeth and the individual ratchet teeth are cooperatively shaped so that when cap 63 is screwed onto spout 62, the lug teeth ride up and over the ratchet teeth. However, when cap 63 is attempted to be unscrewed from the spout, the lug teeth lock into the ratchet teeth thereby preventing removal of the cap. The direction of screwing the cap onto the spout is disclosed by arrow 77 and the direction of unscrewing the cap from the spout is denoted by arrow 78.

The external threads disposed about spout 62 are located above the two series of ratchet teeth, thus permitting engagement of the lug teeth and ratchet teeth as the cap is screwed onto the spout. Due to the particular sawtooth configurations described, minimal resistance is met as the cap is applied to the spout, but once secured in position, the cap cannot be removed without destruction of the cap or, in accord with the present invention, by compressing the two ribbed areas to a point that the cap is distorted so as to push the individual lug teeth out of engagement with the ratchet teeth.

The primary difference to be noted between the spout and cap assembly of FIG. 1 and that of FIG. 7 are the single-wall construction (FIG. 7) as opposed to a double-wall construction, and a series of sawteeth associated with each lug means as opposed to a single lug. The single-wall construction offers a lower-cost option and the series of lug teeth as part of the lug means provides a larger number of points of engagement. However, since the lug means of FIG. 7 are wider in radial span than the single lug of FIG. 1, a slightly greater distorting force may be needed in order to simultaneously disengage all portions of both lug means from the two series of ratchet teeth when the two ribbed areas are compressed. The remainder of the operation and engagement of the cap and spout of FIG. 7 is substantially the same as that of FIG. 1.

Figure 8:
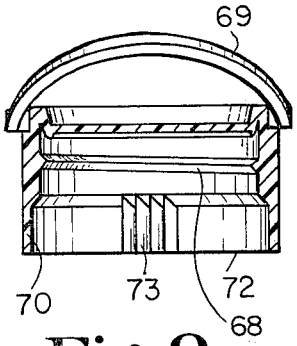
FIG. 8 is a side elevation view in full section of the closure cap portion of the FIG. 7 safety container.
Figure 9:
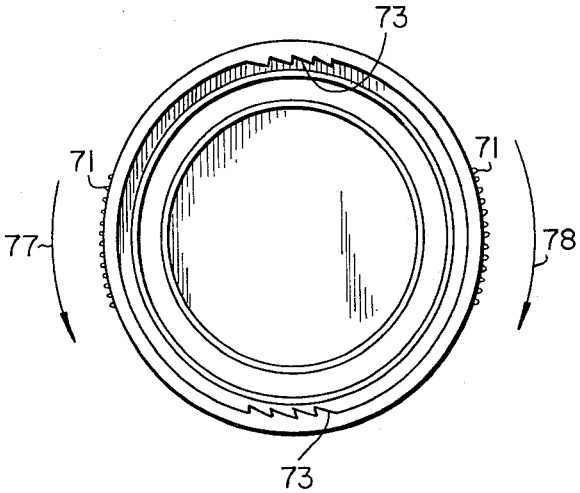
FIG. 9 is a bottom plan view of the FIG. 8 closure cap portion.
Figure 10:
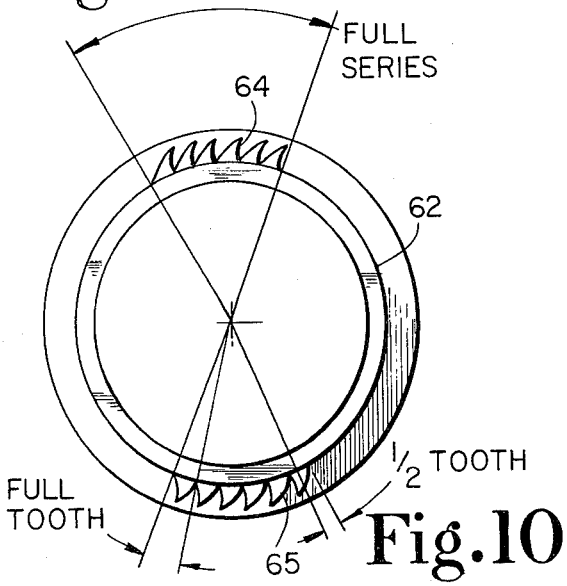
FIG. 10 is a top plan view of detent means comprising a portion of the FIG. 7 safety container as arranged onto the spout of a corresponding container.

Similarly, the construction and details of FIGS. 8, 9 and 10 substantially coincide with corresponding FIGS. 2, 3 and 4 with the exception of those differences already noted. In this regard, it is also to be noted that spout 62 is part of an extendable spout and closure assembly wherein the spout is anchored to the raised boss of a container by anchor ring 76. Closure cap 63 in combination with bail handle 69 is used to pull outwardly on spout 62 so as to extend it from its nested orientation. However, when in this nested orientation, the spout is folded along an invertible fold portion and the upper part is actually tucked within the lower part. This causes the threaded portion and the ratchet tooth portion of the spout to be surrounded by the base portion of the spout, and when the cap is screwed onto the spout, the two ribbed areas of the cap become inaccessible for manual compression. While the bail handles are used to pull the spout from its nested orientation, a suitable downward force will collapse the spout causing it to fold within itself and place it in the nested orientation.

U.S. Pat. No. 3,613,966, issued Oct. 19, 1971 to Kenneth L. Summers and assigned to the assignee of the present invention, discloses a nestable pouring spout having a flexible wall with a portion reversible in curvature upon extension of the spout. This patent reference substantially describes nestable pouring spout 62 as disclosed herein. Consequently, for its disclosure of the nestable pourable spout concept, U.S. Pat. No. 3,613,966 is hereby incorporated by reference.

The necessity to compress and turn the cap (this apples to the FIG. 1 closure and equally to the FIG. 7 closure) twice in succession in order to remove it provides a very secure, double-action release requirement which is not able to be performed by small children and infants. It has been demonstrated by authorities in the field of behavioral science that preschool age children are generally incapable of concurrently performing two dissimilar manual actions. Therefore, the operations required to remove the closure cap from the container spout require first that the cap be compressed while at the same time unscrewing the cap from the spout. Further, in order to additionally complicate the child's task, this same procedure must be repeated due to the axial height extent of the series of ratchet teeth.

In the interest of reliability, economy and efficiency, the container, detent member and closure cap in the exemplary embodiment are molded from a suitable thermosetting or thermoforming compound. A suitable material for this product is polyethylene. It is further to be noted that in the two embodiments disclosed, the closure cap is a single-piece integral member which does not have any piece parts to be assembled nor does it require any modification after the initial molding stage. Similarly, the container and the container spout are molded and integrally molded therewith, in the exemplary embodiments, are the detent means.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A child-resistant safety container of the type having a spout and closure cap, said closure cap and spout being cooperatively arranged into a positive-on style and necessitating a two-step release procedure for removal of said cap from said spout, said safety container comprising:

a container body having an externally threaded pour spout;

detent means disposed about said pour spout and including two series of ratchet teeth, the leading edge of the first ratchet tooth of one series being radially spaced from the first ratchet tooth of the other series; and a flexible, internally threaded closure cap cooperatively arranged for threaded engagement of said spout and having a side wall and two inwardly directed lug means disposed on the interior surface of said cap substantially 180 degrees apart and suitably arranged to provide a positive-on lock with said two series of ratchet teeth, said two lug means each having an axial height of sufficient magnitude to necessitate more than one turn of 180 degrees of said cap relative to said spout in order to disengage the positive-on lock of said lug means with said ratchet teeth.

2. The safety container of claim 1 wherein said lug means includes two series of lug teeth, each series having a plurality of said lug teeth which are cooperatively arranged to engage corresponding ratchet teeth of said two series of ratchet teeth.

3. The safety container of claim 2 which further includes two series of squeeze ribs oppositely disposed on the exterior surface of said closure cap and evenly spaced between said two lug means, compression toward each other of said squeeze ribs pushing said lug means out of engagement with their corresponding series of ratchet teeth.

4. The safety container of claim 3 wherein said pour spout is nestable and in said nested condition said squeeze ribs are inaccessible to manual compression.

5. The safety container of claim 1 which further includes two series of squeeze ribs oppositely disposed on the exterior surface of said closure cap and evenly spaced between said two lug means, compression toward each other of said squeeze ribs pushing said lug means out of engagement with their corresponding series of ratchet teeth.

* * * * *